US006095824A

United States Patent [19]

McHugh

[11] Patent Number: 6,095,824

[45] Date of Patent: Aug. 1, 2000

[54] ELECTRICAL CONNECTOR ASSEMBLY

[75] Inventor: Robert G. McHugh, Evergreen, Colo.

[73] Assignee: Hon Hai Precision Ind. Co., Ltd., Taipei Hsien, Taiwan

[21] Appl. No.: 09/221,182

[22] Filed: Dec. 23, 1998

Related U.S. Application Data

[63] Continuation-in-part of application No. 08/795,753, Feb. 6, 1997, Pat. No. 5,915,976.

[51] Int. Cl.[7] ..... H01R 12/00

[52] U.S. Cl. ..... 439/74; 439/108

[58] Field of Search ..... 439/74, 95, 108, 439/83, 570

[56] References Cited

U.S. PATENT DOCUMENTS

| | | | |
|---|---|---|---|
| 5,626,482 | 5/1997 | Chan et al. | 439/74 |
| 5,915,976 | 6/1999 | McHugh | 439/74 |
| 5,928,003 | 7/1999 | Kajinuma | 439/74 |
| 5,971,800 | 10/1999 | Azuma et al. | 439/108 |

*Primary Examiner*—Brian Sircus
*Assistant Examiner*—T. C. Patel

[57] ABSTRACT

A board-to-board connector assembly includes a plug connector and a receptacle connector having first and second housings receiving first and second contacts therein, respectively. Tail sections of the contacts are surface mounted to PCBs on which the plug and receptacle connectors are seated. A pair of mounting retainers are disposed in corresponding mounting recesses defined in opposite distal ends of both the first and second housings. The mounting retainers are inserted into the corresponding mounting recesses of the plug and receptacle connectors from top surfaces thereof. The tail portions of the contacts and bottom surfaces of the horizontal portions of the mounting retainers are surface mounted onto the corresponding PCBs. The plug and receptacle connectors are then mated together to electrically connect the PC boards.

12 Claims, 5 Drawing Sheets

ELECTRICAL CONNECTOR ASSEMBLY

This application is a continuation-in-part of the application Ser. No. 08/795,753 filed Feb. 6, 1997, now U.S. Pat. No. 5,915,976.

BACKGROUND OF THE INVENTION

1. Field of the Invention

The present invention relates to a board-to-board connector assembly, and particularly to a board-to-board connector assembly including a pair of plug and receptacle connectors mated with each other wherein a pair of mounting retainers are inserted from a top surface of each connector for strengthening the retention thereof on a related printed circuit board.

2. The Prior Art

A board-to-board connector assembly is used for directly connecting a daughter board to a mother board, without the necessity of using an auxiliary device such as a cable. Board-to-board connector assemblies generally include a pair of plug and receptacle connectors respectively mounted on two parallel spaced PC boards and adapted to mate with each other for providing mechanical and electrical interconnection therebetween, whereby the corresponding PC boards can be electrically connected with each other for signal transmission.

Tail sections of contacts received in each connector are surface mounted to the related board for electrically connecting with corresponding contact pads formed thereon. Mounting ears disposed in recesses defined in lateral ends of each connector are inserted therein from a bottom surface thereof. The mounting ears are then surface mounted to the related PCB to retain each connector thereon as disclosed in U.S. Pat. No. 5,626,482.

Since the mounting ears are inserted from a bottom surface of each connector and retention arms thereof do not adequately engage therewith, a substantial force is exerted directly on the tail sections of the contacts when the connectors are separated from each other which may adversely affect the signal transmission between the two PCBs.

Hence, an improved board-to-board connector assembly is needed to eliminate the above mentioned defects of the conventional board-to-board connector assembly.

SUMMARY OF THE INVENTION

Accordingly, an objective of the present invention is to provide a board-to-board connector assembly having mounting retainers firmly engaged with lateral ends of each connector thereof and surface mounted to a related PCB.

Another objective of the present invention is to provide a board-to-board connector assembly having mounting retainers inserted into recesses defined in lateral ends of each connector from a top face thereof for strengthening the retention of each connector on a related PCB.

To fulfill the above mentioned objectives, according to one embodiment of the present invention, a board-to-board connector assembly includes a plug connector and a receptacle connector. The plug connector includes an elongate first insulative housing receiving a number of first contacts therein. The receptacle connector includes an elongate second insulative housing receiving a number of second contacts therein. Tail sections of the first and second contacts are surface mounted to a PCB on which the plug and receptacle connectors are seated, respectively.

A pair of mounting retainers are disposed in corresponding mounting recesses defined in opposite distal ends of both the first and second housings, wherein each mounting retainer includes a vertical portion, a horizontal portion and a pair of locking portions vertically extending from opposite ends of the horizontal portion. The vertical portion of each mounting retainer includes a pair of expansion sections laterally projecting from an upper edge thereof. Each locking portion of each mounting retainer includes an engaging tab horizontally projecting from an upper edge thereof.

Corresponding to each mounting retainer, each mounting recess includes a pair of first slots having shoulders formed therein for supporting the expansion sections of the vertical portion, and a pair of second slots for receiving the locking portions, wherein the first housing further forms a pair of engagement blocks for supporting the engaging tabs of the locking portions.

The mounting retainers are inserted into the corresponding mounting recesses of the plug and receptacle connectors from top faces thereof. The tail portions of the first and second contacts and bottom surfaces of the horizontal portions of the mounting retainers are surface mounted onto the corresponding PCB, wherein the contacts and the mounting retainers are electrically connected to corresponding contact pads and a grounding circuit of the PCB, respectively. The plug and receptacle connectors can then be mated together to electrically connect the PC boards.

DETAILED DESCRIPTION OF THE PREFERRED EMBODIMENT

Reference will now be made in detail to the preferred embodiment of the present invention.

Figure 1:
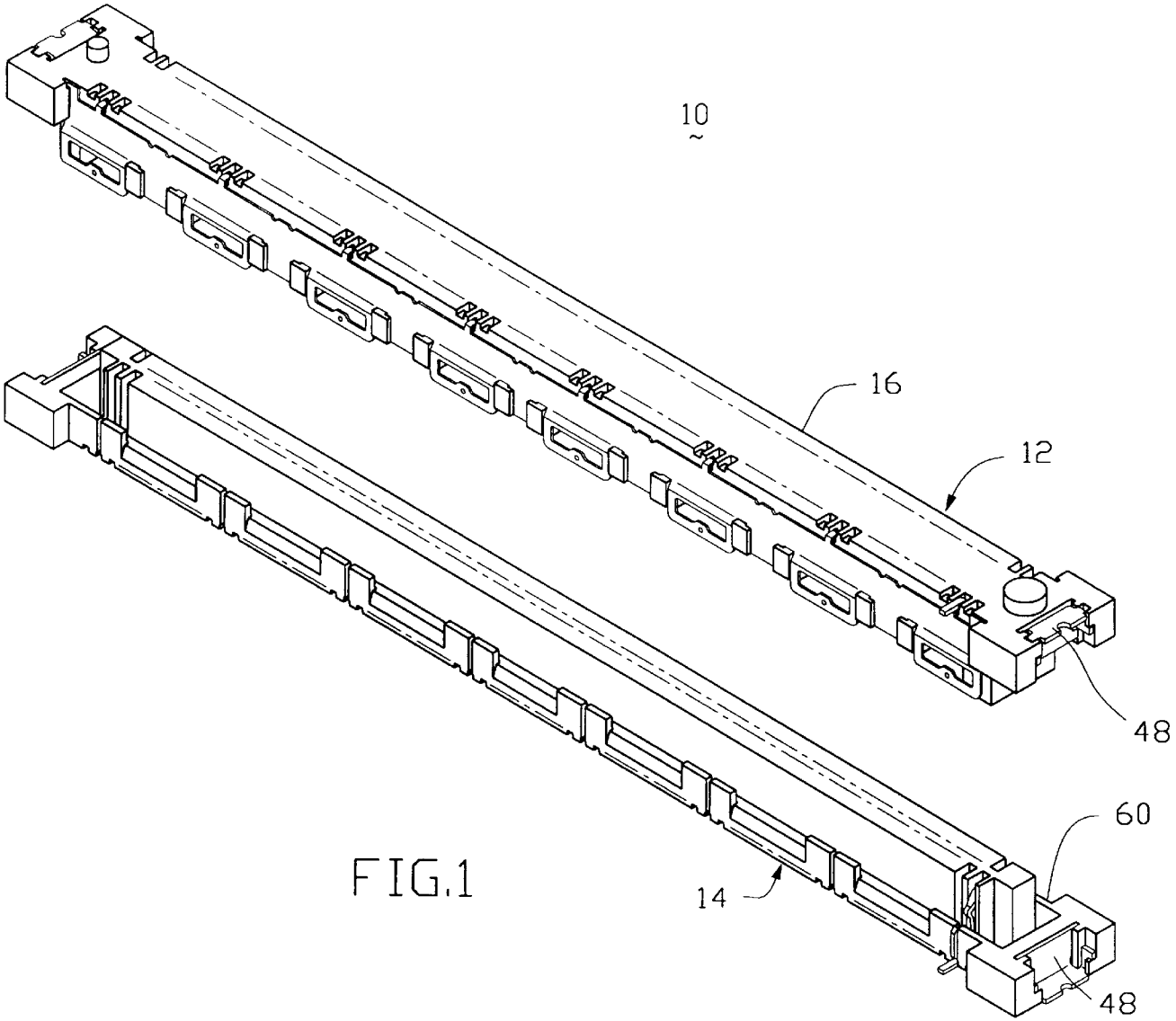
FIG. 1 is a perspective, exploded view of a board-to-board connector assembly in accordance with the present invention.
Figure 2:
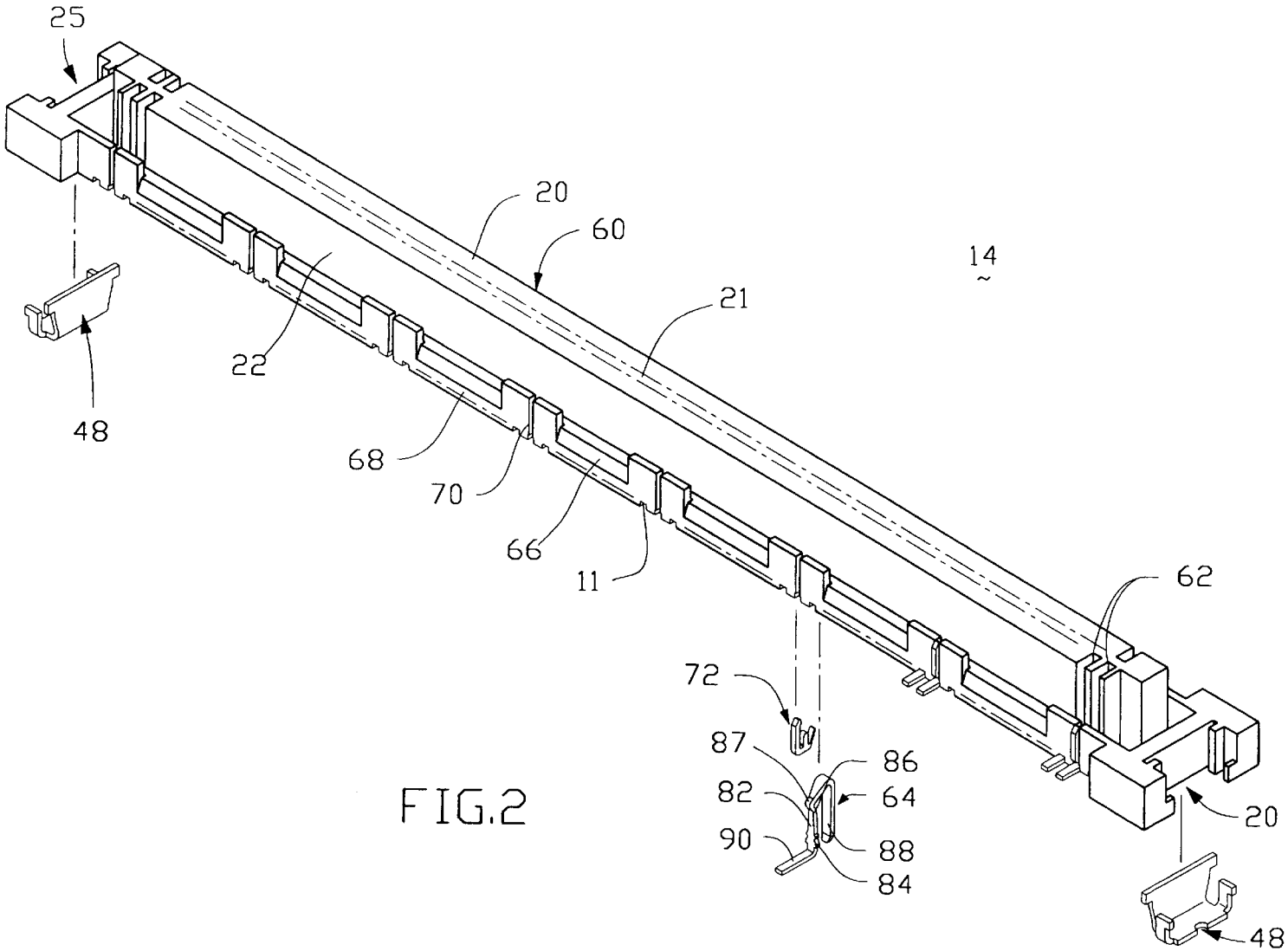
FIG. 2 is a perspective, exploded view of a plug connector in accordance with the present invention.

Referring to FIGS. 1 and 2, a board-to-board electrical connector assembly 10 in accordance with the present invention consists of a plug connector 14 and a receptacle connector 12.

The plug connector 14 includes an elongate first insulative housing 60 having an outer wall 66, a central ridge 20 located within the outer wall 66, a bottom face (not shown) for proximity to a printed circuit board (not shown), and a top face 21 defined on the ridge 20. A plurality of first passageways 62 are defined in side walls 22 of the ridge 20 from the top face 21 through the bottom face for receiving a corresponding number of first contacts 64 therein. Slots 70 are defined along each outer wall 66 for receiving grounding contacts 72 therein. Each grounding contact 72 has a portion contacting with a corresponding first contact 64 which is connected to a grounding circuit of the PCB on which the plug connector 14 is mounted.

Each first contact 64 includes a main body 82 with barb sections 84 for interferential engagement within a corresponding channel (not shown) defined in an inner surface of each outer wall 66 of the first housing 60. A bellow type engagement section 86 extends upward from the main body 82 wherein an engagement apex 87 protrudes out of the corresponding passageway 62 of the first housing 60. A butting section 88 is disposed at a distal end thereof for abutment with an interior surface of the first passageway 62. Each first contact 64 further includes a tail section 90 for surface mounting to a related PCB (not shown) on which the plug connector 14 is seated.

Figure 4:
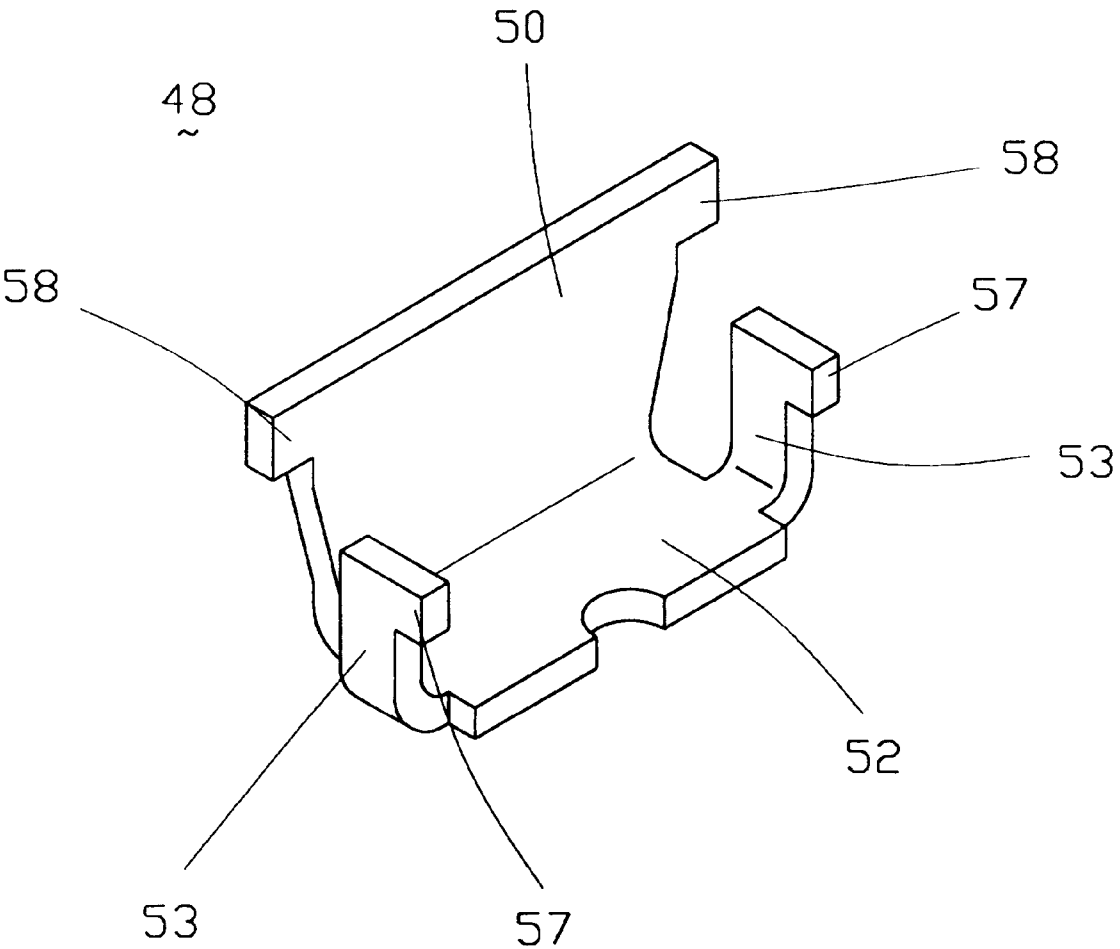
FIG. 4 is a perspective view of a mounting retainer in accordance with the present invention.

Referring also to FIG. 4, a pair of mounting retainers 48 are disposed in corresponding mounting recesses 25 defined in opposite distal ends of the first housing 60, wherein each mounting retainer 48 includes a vertical portion 50, a horizontal portion 52 and a pair of locking portions 53 vertically extending from opposite ends of the horizontal portion 52. The vertical portion 50 of each mounting retainer 48 includes a pair of expansion sections 58 laterally projecting from an upper edge thereof. Each locking portion 53 of each mounting retainer 48 includes an engaging tab 57 horizontally projecting from an upper edge thereof.

Figure 5:
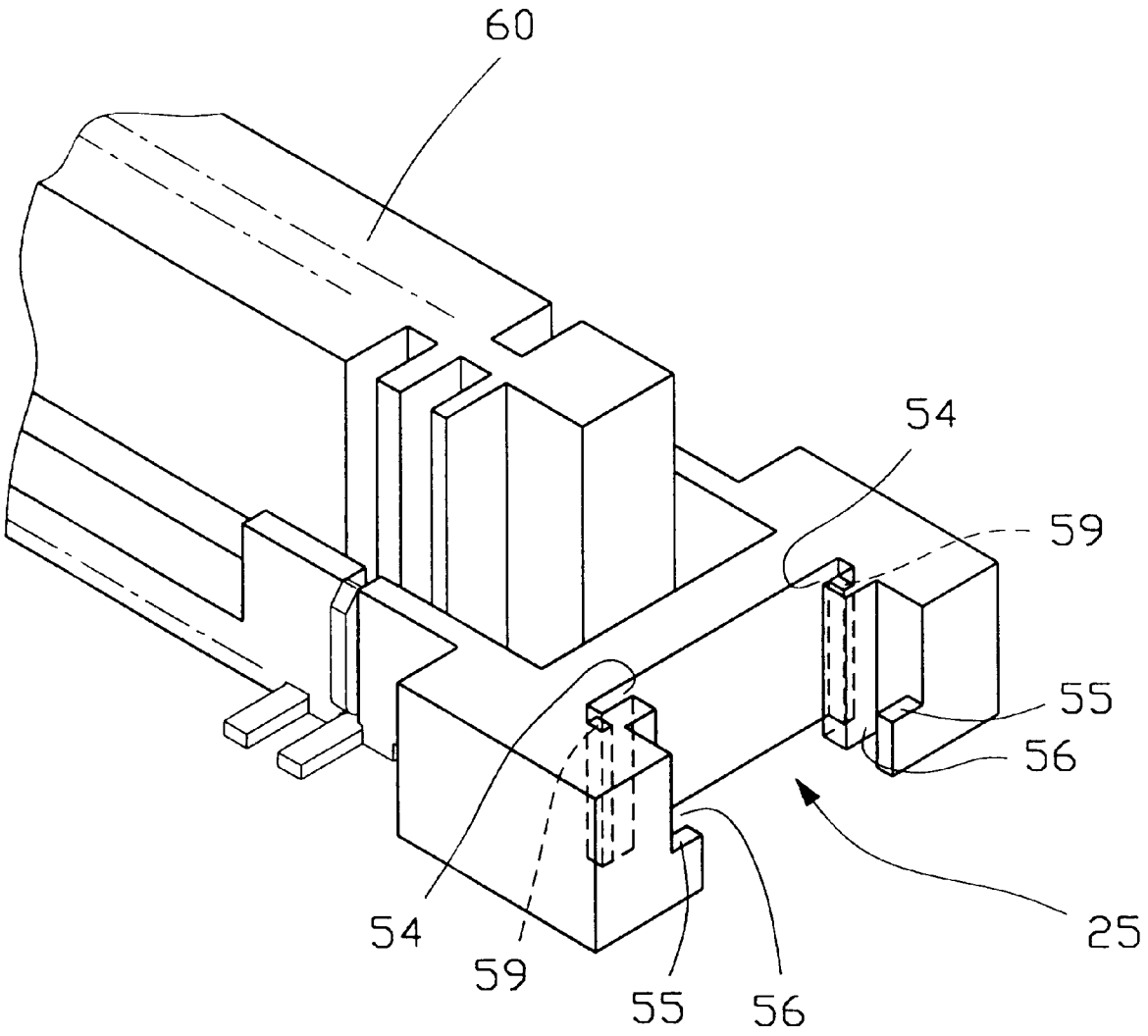
FIG. 5 is a magnified perspective view of a mounting recess of the plug connector of FIG. 2.

Referring also to FIG. 5, corresponding to each mounting retainer 48, each mounting recess 25 of the first housing 60 includes a pair of first slots 54 having shoulders 59 formed therein for supporting the expansion sections 58 of the vertical portion 50, and a pair of second slots 56 for receiving the locking portions 53, wherein the first housing 60 further forms a pair of engagement blocks 55 for supporting the engaging tabs 57 of the locking portions 53.

Figure 3:
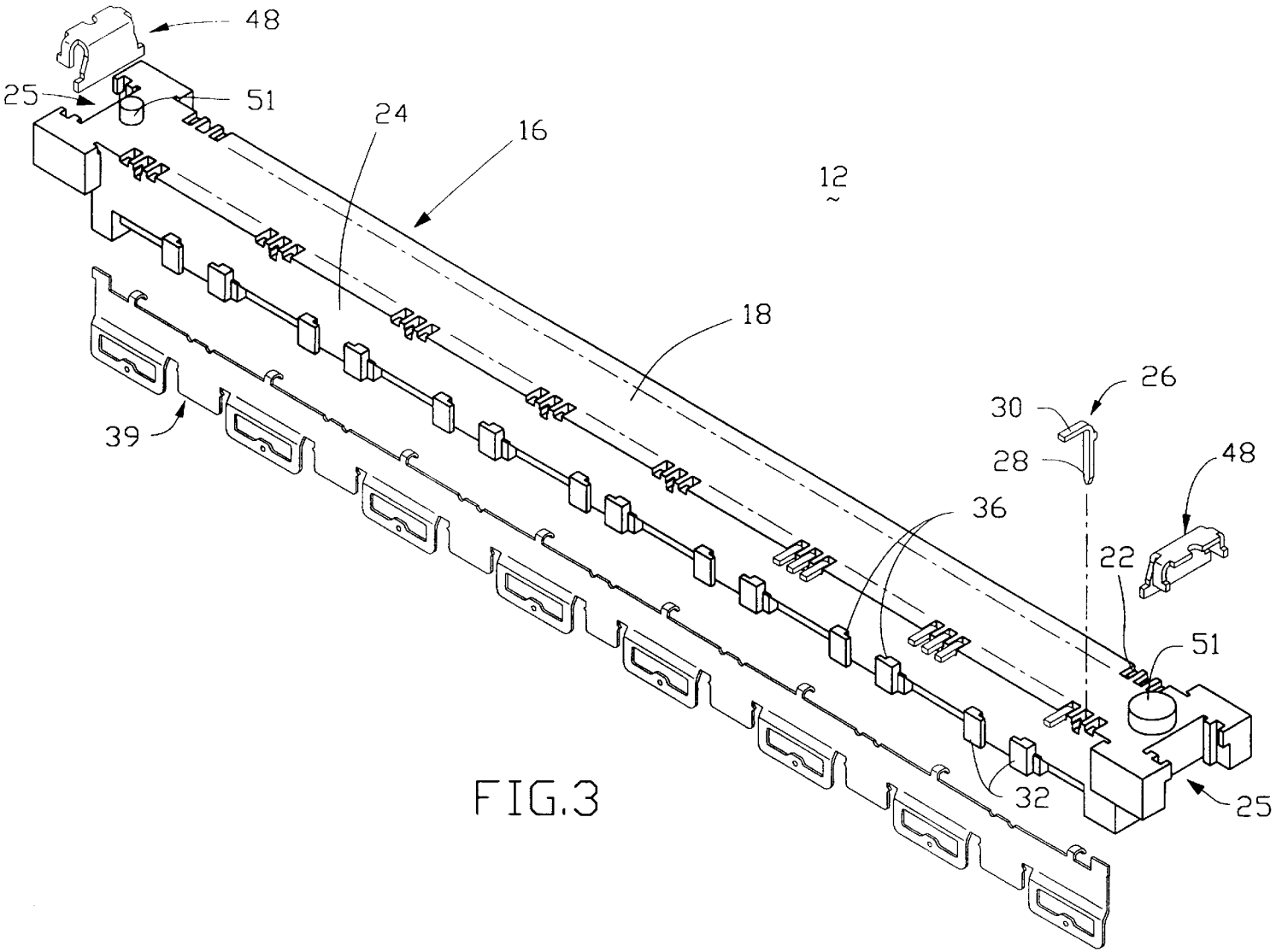
FIG. 3 is a perspective, exploded view of a receptacle connector in accordance with the present invention.

Referring to FIG. 3, the receptacle connector 12 consists of an elongate second insulative housing 16 having a bottom face 18 for proximity to a printed circuit board (not shown), a top face (not shown) for proximity to the plug connector 14, a central cavity (not shown) exposed to the top face for receiving the ridge 21 of the plug connector 14, a plurality of second passageways 22 defined between the cavity and the bottom face 18 for receiving a corresponding number of the second contacts 26 therein, and two lateral walls 24.

Each second contact 26 includes an engagement section 28 and a tail section 30 perpendicular to the engagement section 28, wherein the engagement section 28 abuts against an inner wall of the cavity for electrically connecting with the engaging apex 87 of the corresponding first contact 64 of the plug connector 14 and the tail section 30 is surface mounted to the PCB on which the receptacle connector 12 is seated. A grounding/shielding plate 39 is attached to each lateral wall 24 of the second housing 16. A pair of differently sized posts 51 extend from the bottom face 18 of the second housing 16 for reception within a pair of corresponding differently sized holes in the related PC board.

The receptacle connector 12 defines a pair of mounting recesses 25 in opposite distal ends thereof, wherein the mounting recesses 25 of the receptacle connector 12 are identical to the mounting recesses 25 of the plug connector 14.

In assembly, the first and second contacts 64, 26 are fixedly received in the corresponding first and second passageways 62, 22 of the plug and receptacle connectors 14, 12, respectively. The plates 39 are then respectively attached to the lateral walls of the second housing 16 to electrically connect with corresponding contacts 26 to be soldered to a grounding circuit of the PCB on which the receptacle connector 12 is seated. The mounting retainers 48 are inserted into the corresponding mounting recesses 25 of the plug and receptacle connectors 14, 12 from top surfaces thereof. The tail portions 90, 30 of the first and second contacts 64, 26 and bottom surfaces (not labeled) of the horizontal portions 52 of the mounting retainers 48 are surface mounted onto the corresponding PCB, wherein the contacts 64, 26 and the mounting retainers 48 are electrically connected to corresponding contact pads and a grounding circuit of the PCB, respectively. The plug and receptacle connectors 14, 12 can then be mated together to electrically connect the PC boards.

It can be clearly seen that the plug and receptacle connectors 14, 12 are securely retained on the related PCB due to the engagement between the mounting retainers 48 and the corresponding mounting recesses 25 thereof. When the plug and receptacle connectors 14, 12 are separated from each other, a separation force is primarily exerted on the solder engagement between the mounting retainer 48 and the PCB thereby preventing the force from adversely affecting the solder engagement between the first and second contacts 64, 26 and the corresponding PCB.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. Mounting means for securing an electrical connector on a related printed circuit board (PCB), the electrical connector receiving contacts in passageways defined in a housing thereof, each contact having a tail section surface mounted to the PCB on which the connector is seated, the mounting means comprising:

at least a mounting recess defined in the housing of the connector, each mounting recess including a pair of slots; and an L-shaped mounting retainer including a vertical portion for attaching the mounting retainer to the housing of the connector and a horizontal portion for soldering to the PCB, the horizontal portion forming a pair of locking portions vertically extending from opposite ends thereof for being received in the slots of the mounting recess;

wherein the mounting retainer is inserted into the mounting recess of the connector from a top face thereof for preventing a separation force from adversely affecting the solder engagement between the tail sections of the contacts and the related PCB.

2. The mounting means as described in claim 1, wherein each locking portion includes an engaging tab horizontally projecting from an upper edge thereof.

3. The mounting means as described in claim 2, wherein the mounting recess further forms a pair of engagement blocks for supporting the engaging tabs of the locking portions of the mounting retainer.

4. The mounting means as described in claim 1, wherein the vertical portion includes a pair of expansion sections oppositely and horizontally projecting from opposite edges thereof.

5. The mounting means as described in claim 4, wherein each mounting recess includes another pair of slots having shoulders formed therein for supporting the expansion sections of the vertical portion.

6. A mounting retainer for securing an electrical connector on a related printed circuit board, the electrical connector comprising a housing defining at least a mounting recess and a plurality of passageways for receiving contacts therein, each contact having a tail section surface mounted to the PCB on which the related connector is seated, the mounting retainer disposed in the mounting recess from a top face thereof for preventing a separating force from adversely affecting the solder engagement between the tail sections of the contacts and the related PCB; wherein the mounting retainer further includes a vertical portion with first means thereof for attaching the mounting retainer to the mounting recess, a horizontal portion for mounting the mounting retainer to the PCB, and second means vertically extending from opposite ends of the horizontal portion for achieving the enhancement of attaching the mounting retainer to the mounting recess, the second means including two locking portions perpendicular to both the vertical portion and the horizontal portion, and an engaging tab horizontally projecting from an upper edge of each of said locking portions.

7. The mounting retainer as described in claim 6, wherein the first means includes a pair of expansion sections laterally projecting from an upper edge of the vertical portion.

8. An electrical connector comprising:

a housing defining at least a mounting recess at one end thereof; and a mounting retainer including a vertical portion and a horizontal portion, at least one locking portion vertically extending from one end of the horizontal portion and being perpendicular to both the vertical portion and the horizontal portion; wherein the mounting recess forms a first slot for receiving said vertical portion and a second slot for receiving said locking portion.

9. The connector as described in claim 8, wherein said locking portion further includes an engaging tab extending outward, and said mounting recess further includes an engagement block for supporting said engaging tab.

10. The connector as described in claim 8, wherein said vertical portion further includes an expansion section, and the first slot further forms a shoulder thereabouts for supporting said expansion section.

11. Mounting means for securing an electrical connector on a related printed circuit board (PCB), the electrical connector receiving contacts in passageways defined in a housing thereof, each contact having a tail section surface mounted to the PCB on which the connector is seated, the mounting means comprising:

at least a mounting recess defined in the housing of the connector; and an L-shaped mounting retainer including a vertical portion for attaching the mounting retainer to the housing of the connector and a horizontal portion for soldering to the PCB;

wherein the mounting retainer is inserted into the mounting recess of the connector from a top face thereof for preventing a separation force from adversely affecting the solder engagement between the tail sections of the contacts and the related PCB, and the horizontal portion forms a pair of locking portions vertically extending from opposite ends thereof, each locking portion including an engaging tab horizontally projecting from an upper edge thereof, the mounting recess further forming a pair of engagement blocks for supporting the engaging tabs of the locking portions of the mounting retainer.

12. Mounting means for securing an electrical connector on a related printed circuit board (PCB), the electrical connector receiving contacts in passageways defined in a housing thereof, each contact having a tail section surface mounted to the PCB on which the connector is seated, the mounting means comprising:

at least a mounting recess defined in the housing of the connector; and an L-shaped mounting retainer including a vertical portion for attaching the mounting retainer to the housing of the connector and a horizontal portion for soldering to the PCB;

wherein the mounting retainer is inserted into the mounting recess of the connector from a top face thereof for preventing a separation force from adversely affecting the solder engagement between the tail sections of the contacts and the related PCB, the vertical portion includes a pair of expansion sections oppositely and horizontally projecting from opposite edges thereof, and each mounting recess includes another pair of slots having shoulder formed therein for supporting the expansion sections of the vertical portion.

* * * * *